US005398831A

United States Patent [19]

Avramides et al.

[11] Patent Number: 5,398,831

[45] Date of Patent: Mar. 21, 1995

[54] AIR CARGO CONTAINERS

[75] Inventors: Andrew Avramides; Philip Henstock, both of London, England

[73] Assignee: Lite Flite Limited, Jersey, Channel Islands

[21] Appl. No.: 85,688

[22] Filed: Jun. 25, 1993

Related U.S. Application Data

[63] Continuation of Ser. No. 903,442, Jun. 24, 1992, abandoned.

[30] Foreign Application Priority Data

Jun. 25, 1991 [GB] United Kingdom ..... 9113702

[51] Int. Cl.[6] ..... B65D 7/00

[52] U.S. Cl. ..... 220/1.5; 220/453

[58] Field of Search ..... 220/453, 464, 677, 678, 220/1.5

[56] References Cited

U.S. PATENT DOCUMENTS

| | | | |
|---|---|---|---|
| 3,563,403 | 2/1971 | Luisada | 220/1.5 |
| 3,575,312 | 4/1971 | Luisada | 220/1.5 |
| 3,655,087 | 4/1972 | Luisada | 220/1.5 |
| 3,669,815 | 6/1972 | Desai et al. | 220/464 |
| 3,692,203 | 9/1972 | Byrd et al. | 220/1.5 |
| 3,734,811 | 5/1973 | Small et al. | 220/453 X |
| 3,854,620 | 12/1974 | Saidla | 220/453 |
| 3,915,327 | 10/1975 | Lovich et al. | 220/1.5 |
| 3,968,895 | 7/1976 | Barnes et al. | 220/1.5 |
| 4,325,488 | 4/1982 | Ketner | 220/1.5 |
| 4,799,600 | 1/1989 | Gunn et al. | 220/1.5 |
| 4,860,912 | 8/1989 | Kupersmit | 220/1.5 |
| 4,964,530 | 10/1990 | Graaff | 220/1.5 X |

FOREIGN PATENT DOCUMENTS

| | | |
|---|---|---|
| 751756 | 1/1967 | Canada . |
| 1441816 | 5/1966 | France . |
| 2029748 | 4/1971 | Germany . |
| 1065805 | 4/1967 | United Kingdom . |
| 1284917 | 8/1972 | United Kingdom . |
| 1507042 | 4/1978 | United Kingdom . |
| 2195613 | 4/1988 | United Kingdom . |

*Primary Examiner*—Steven M. Pollard

*Attorney, Agent, or Firm*—Watson, Cole, Grindle & Watson

[57] ABSTRACT

An air cargo container includes a base, side walls and a roof, the side walls and roof being made of panels of a composite structural sheet material which is capable of sustaining the tensile, compressive and shear loads to be carried by the container, the panels being connected together and to the base along their edges in the absence of a structural framework. The composite structural material includes three layers, a core layer of a closed cell foam and outer structural layers including thermosetting plastics sheet material and aluminium alloy sheet material. At least some of the side walls are vertical and planar over their entire extents and, at their lower edges, are surrounded by a laterally projecting flange for use in anchoring the container in the cargo hold.

16 Claims, 4 Drawing Sheets

AIR CARGO CONTAINERS

CROSS REFERENCE TO RELATED APPLICATION

This application is a continuation of application Ser. No. 903,442, filed Jun. 24, 1992, now abandoned.

BACKGROUND OF THE INVENTION

The present invention is concerned with improvements in and relating to air cargo containers of the type used for the transport of cargo, baggage and mail.

Conventional air cargo containers presently in use are made with a base and an internal framework of columns and beams fixed to the base and defining the aft, forward and lateral side walls, door openings and roof. The framework is spanned by aluminium sheet material riveted to the columns and beams. Surrounding the lower edge of the base there is an outwardly projecting flange which is engaged by clamps fixed to the floor of the aircraft to anchor the container in place. To increase the useful space within the container, the columns of the framework can be stepped laterally outwardly from the plane of their attachment to the base of the container, so that they extend over the flange. This, however, has the disadvantage of weakening the framework in the region of its connection to the base and of making the connection more complex and therefore costly. Furthermore, in use, the walls of adjacent containers have a tendency to bind.

Such air cargo containers are required to conform to various national and international standards and specifications such as those of the U.S. Federal Aviation Administration (FAA), International Air Transport Association (IATA), U.S. National Aerospace Standard Board (NAS), U.S. Federal Aviation Regulations (FAR) and European Joint Aviation Regulations (JAR), which set out the characteristics which such air cargo containers must have, such as, for example, the ability to sustain defined vertical and lateral loads and impacts, shear forces and fire resistance.

Modifications of the conventional air cargo containers as described above, have been proposed, such for example as in Canadian Patent Specification No. 751756, UK Patent Specifications Nos. 1065805, 1284917, 1507042 and 2195613 and U.S. Pat. Nos. 3,563,403, 3,692,203 and 3,968,895, but as far as the applicants are aware none of these proposals have resulted in an air cargo container which conforms to the various national and international standards and specifications referred to above.

SUMMARY OF THE INVENTION

According to the present invention there is provided an air cargo container comprising a base, side walls and a roof, wherein the side walls and roof are made of panels of a composite structural material comprising at least three layers, the outer layers of which are capable of sustaining the tensile, compressive and shear loads to be carried by the container, the panels being connected together and to the base in the absence of a structural framework.

The present invention enables an improved air cargo container to be provided which can have a significantly improved volume to weight ratio, is lighter, for example may be up to half the weight of existing containers, may have a smoother interior which facilitates filling, a more durable construction, satisfies the standards and specifications set out above and can compete competitively pricewise with existing air cargo containers.

This is achieved by using a design which eliminates the columns and beams of the containers currently in use, the imposed loads being transferred into the material of the walls of the container.

Because of the absence of an internal framework, there is no longer need to provide a step in the side walls of the container. Advantageously, those of the side walls of the container which are generally vertical are planar over their full extents. One side wall of the container may be shaped, as is conventional, to correspond to the shaping of the hold of the aircraft, the other side walls may all be planar and vertical.

The container may, as is conventional, comprise a flange surrounding the base of the container and projecting outwardly therefrom for use in anchoring the container.

The lower edges of the panels of the side walls may overlie edges of the base panel and may be fixed thereto by means fixing the structural layers of the composite material of the side wall panels to the base panel. The means may comprise U-shaped channel members in which the lower edge portions of the side wall panels are received and to which the structural layers of the panels are fixed, the bases of such channel members being fixed to the base panel. The flange may be made integral with the U-shaped channel members. The panels are preferably fixed to the U-shaped channel members by removable fixing means, such as rivets.

Adjacent edge portions of the panels of the side walls and roof may be juxtaposed and fixed together by means fixed to the structural layers of the composite material of the panels. The fixing means may comprise U-shaped channel members in which the edge portions of the panels of the side walls and roof are received and to which they are fixed. The channel members along juxtaposed panel edges are abutted together with the base of one channel member abutted against the side of the other channel member, the channel members being fixed together. The one channel member may have a lateral extension which overlies the base of the other channel member and is also fixed thereto. The means fixing the side wall and roof panels to the U-shaped elements are advantageously removable fixing means, such as rivets.

In a preferred construction, the roof and one pair of opposed side walls are formed integrally from a single piece of composite structural material formed to the required shape. Where the container has one wall shaped to conform to the cargo hold, that side wall may form one of the pair of side walls which are formed integrally with the roof.

As is conventional, the container may have at least one opening in one side wall with closure means for closing the opening.

The preferred composite material for the side walls and roof has a specific gravity which is substantially less than that of aluminium. It comprises three layers, being a central core layer which is preferably formed of a lightweight and stable material, such for example as a closed cell foam, a first outer structural layer which is on the outside of the container and a second outer structural layer which is on the inside of the container. The closed cell foam of the core layer may be made of polyvinylchloride, polyurethane or polymethacrylimide.

The structural outer layers of the composite material preferably comprise thermo-setting plastics sheet material and a non-ferrous metallic sheet material, preferably aluminium alloy sheet material. Preferably the first outer structural layer of the composite material comprises an aluminium alloy sheet material bonded to a thermo-setting plastics sheet material, e.g. of phenolic resin, which may be reinforced with glass fibres. The plastics sheet material is arranged between the aluminium alloy sheet and the core layer so that the aluminium alloy sheet forms the exterior covering of the container.

The second structural outer layer of the composite material preferably comprises a thermo-setting plastics sheet material, for example made of polycarbonate resin or phenolic resin, which may be reinforced with glass fibres. This layer may be provided with a moisture excluding protective non-structural plastics film which may, for example, be made of polyvinylfluoride.

The structural layers may be bonded, e.g. with an appropriate adhesive, which can be in the form of a film, to the core layer under heat and pressure. Alternatively a cold applied adhesive may be used.

The base of the container may be made of a single layer of non-ferrous metallic sheet material, preferably aluminium alloy, or a composite material comprising a core layer of a thermo-setting plastics material, e.g. a phenolic resin, which may be reinforced with glass fibres, and outer layers of a non-ferrous metallic sheet material, preferably aluminium alloy sheet material.

Where the roof and two opposed side walls of the container are made from a single piece of composite material, the layers of the composite material may be assembled in an appropriately shaped former or they may be assemble flat and then shaped.

Further features of the present invention will become apparent from the following description of an embodiment thereof, given by way of example only, with reference to the accompanying drawings, in which:

DETAILED DESCRIPTION OF THE PREFERRED EMBODIMENT

Figure 1:
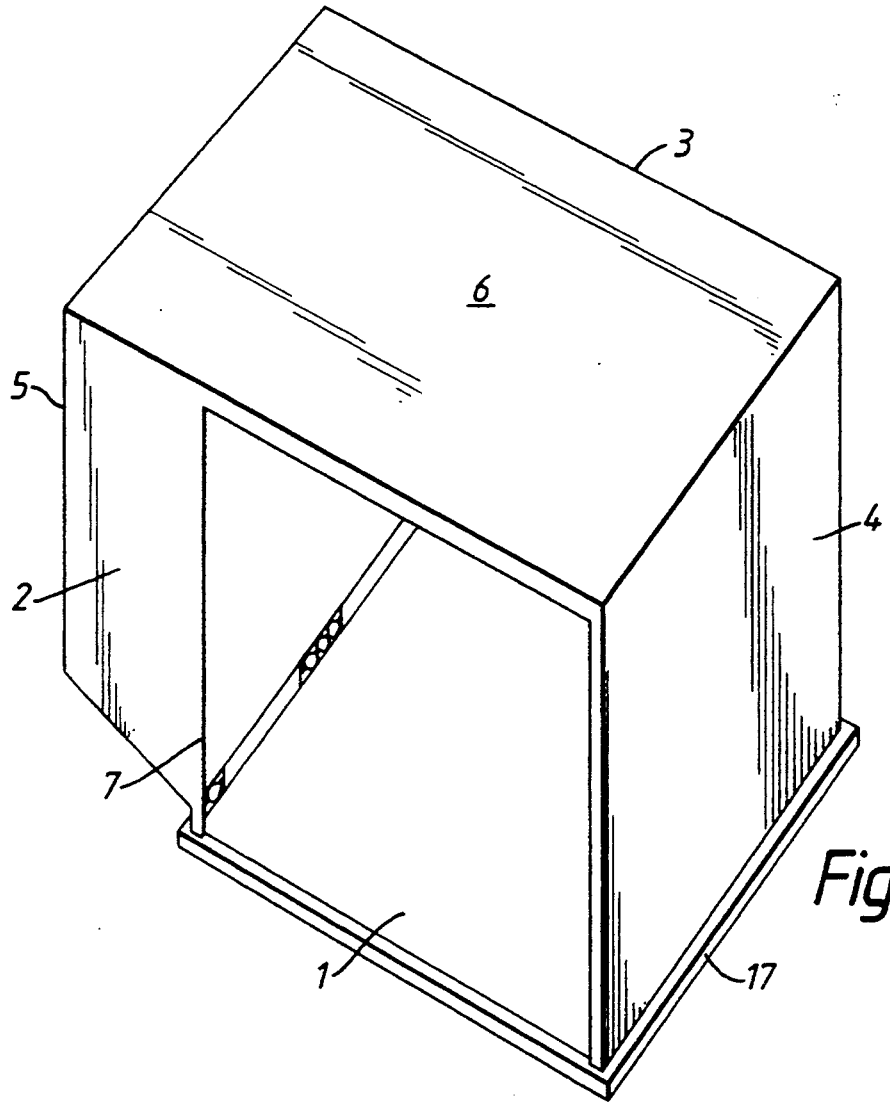
FIG. 1 is an isometric view of an embodiment of an air cargo container according to the present invention.

The air cargo container shown in the drawings is, as is required by national and international standards and specifications, generally rectangular in plan and comprises a generally rectangular base 1, a planar vertical aft side wall 2, a planar vertical forward side wall 3, a planar vertical first lateral side wall 4. The second lateral side wall 5 may also be planar and vertical but, as shown, is shaped to generally conform to a cargo hold and has a main planar vertical upper part 5*a*, a main planar lower part 5*b* which is inclined inwardly from the upper part 5*a* towards the edge of the base 1, and a planar vertical lower part 5*c* which is connected to the base. The roof 6 is generally rectangular but laterally larger than the base 1. The wall 2 is provided with an opening 7 for access to the container and a suitable conventional closure 8. A similar opening and closure may be provided in the opposed wall 3. A flange 17 is provided surrounding the container at its base for use in anchoring the container to the surface on which it is supported, the flange projecting laterally beyond the vertical planes of the side walls 2, 3 and 4. In use, these walls will be spaced by the width of two flanges from the corresponding walls of adjacent containers and this should eliminate binding between adjacent walls of adjacent containers.

Figure 2:
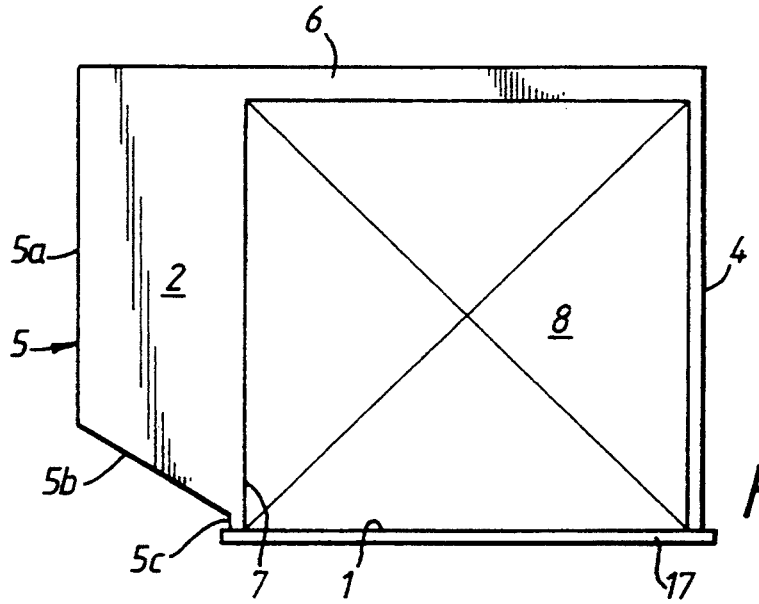
FIG. 2 is an aft view of the container shown in FIG. 1.

It will be appreciated that while a particular type of air cargo container is shown in FIGS. 1 and 2, the invention is equally applicable to other types of air cargo containers and to containers with other configurations of openings 7.

The base 1 is made of a material having a shear strength of at least 7,300 psi (50 Mpa). It may be made of an aluminium alloy sheet material which is preferably about 2.5 mm thick. Alternatively, the base 1 may be made of a composite material comprising a core layer of phenolic resin sheet material reinforced with glass fibres, and outer layers of an aluminium alloy sheet material, the composite material being about 2.8 mm thick. The second alternative is preferred because it provides a higher weight base.

The walls 2 to 5 and roof 6 are made of panels of a composite material comprising three layers, being a central core layer 9*a* and outer structural layers 9*b* and 9*c*. The core layer 9*a* is made of closed cell polyvinylchloride foam having a density of at least 4 lbs/ft$^3$ (60 kg/m$^3$), a compression strength of at least 100 psi (0.69 Mpa), a tensile strength of at least 200 psi (1.38 Mpa) and is 10.00 mm thick.

The outer structural layers 9*b*, 9*c* on either side of the core layer are capable of sustaining the tensile, compressive and shear forces imposed on the container. The first structural layer 9*b*, which will be outermost on the container and provide the outer surface of the container, comprises aluminium alloy sheet material $9b_1$ having a thickness of 0.30 mm backed by a stiffening sheet $9b_2$ of phenolic resin reinforced with glass fibres having a thickness of 0.2 mm. The aluminium alloy sheet 9*b* has a density of at least 168 lbs/ft$^3$ (2690 kg/m$^3$), a compressive strength of at least 21,500 psi (150 Mpa) and a tensile strength of at least 20,000 psi (140 Mpa). The stiffening sheet $9b_2$ has a density of at least 107 lbs/ft$^3$ (1710 kg/m$^3$), a compressive strength of at least 46,000 psi (320 Mpa) and a tensile strength of at least 46,000 psi (320 Mpa).

The second structural outer layer 9*c*, which forms the inner surface of the walls and roof of the container, comprises phenolic resin sheet material reinforced with glass fibres, and has a thickness of 0.22 mm, a density of at least 120 lbs/ft$^3$ (1920 kg/m$^3$), a compressive strength of at least 49,000 psi (340 Mpa) and a tensile strength of at least 49,000 psi (340 Mpa). This layer 9*c* may be provided with a non-structural sealing or moisture-excluding film 9*d* made of polyvinylfluoride which is 0.02 mm thick.

The various layers of the composite material are bonded together using, for example, an epoxy adhesive, under heat and pressure appropriate to the materials from which the composite material is made. The layers of the composite material may, for example, be bonded together in a press or mould with heat, applied either locally or by an autoclave, sufficient to cure the thermosetting plastics materials. For the materials as described above, the preferred temperature is 80° C. and the pressure is 1.5–2 bars (22–30 psi).

The composite material described above, and its constituent materials, satisfy the fire resistance requirements of the relevant standards and specifications referred to above.

Although as described above the roof is made of the same composite material as the side walls, it may be made of a slightly different composite material having structural outer layers and a closed cell foam core.

Figure 3:
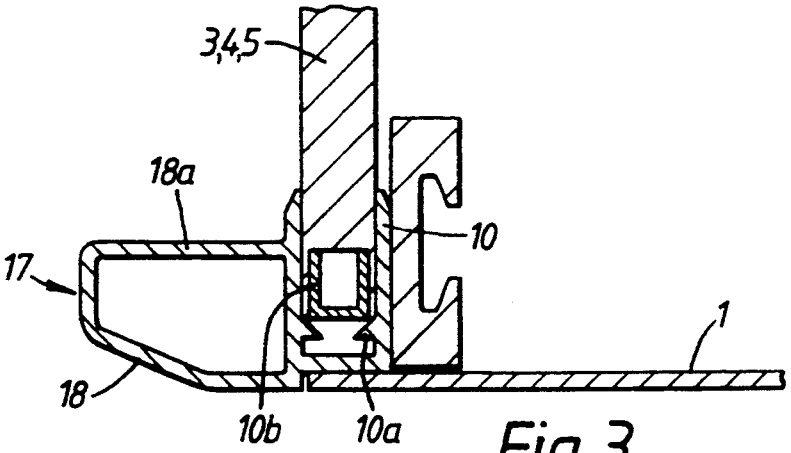
FIG. 3 is a vertical section through the junction between the base and a forward, aft or lateral side wall of the container of FIG. 1.
Figure 4:
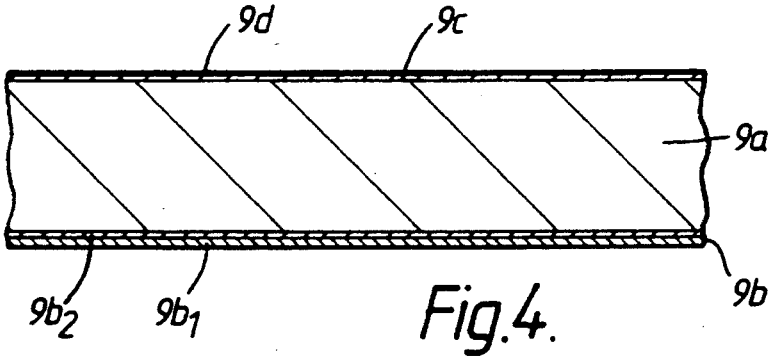
FIG. 4 is a section through a wall of the container of FIG. 1.

The lower edge portions of the panels of the side walls 2 to 5 overlie and are fixed to corresponding edge portions of the panel of base 1 by U-shaped channel elements 10 (FIG. 3), each extending the full length of the lower edge of the respective wall panel. Each panel is fixed to its element 10 by rivets projecting through the walls of the element 10 and the structural layers of the composite material of the panel. As shown, the element 10 is formed with positioning lugs 10*a* within the channel and on which the lower edge of the panel rests. The bases of the elements 10 are then fixed, e.g. by rivets, to the respective edge portion of the base panel. The connection of the lower edge portions of each side wall panel to the base panel may be strengthened by inserting a U-shaped member 10*b* in the edge of the panel between the structural layers 9*b*, 9*c*, having removed, e.g. with a router, an appropriate strip of the foam core 9*a*. Rivets are then inserted through the walls of element 10, the structural layers 9*b*, 9*c* and the walls of member 10*b*.

Figure 5:
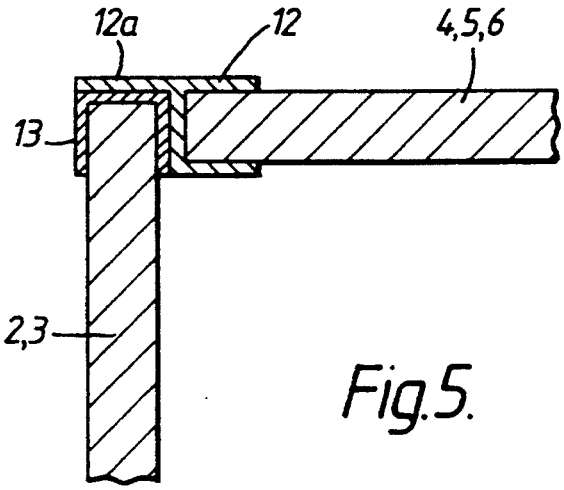
FIG. 5 is a section through the junction between adjacent side walls or between one side wall and the roof of the container of FIG. 1.

At the corners between adjacent side wall panels and between the side wall panels and the roof, the edge portions of the panels are juxtaposed and connected together by members 12 and 13 (FIG. 5) which extend along the respective edges of the panels and which are fixed to each other and to the structural layers 9*b*, 9*c* of the composite material of these panels. Each member 12, 13 has a U-shaped part providing a channel for receiving the edge portion of the respective roof or wall panel and the members 12, 13 are abutted with the base of the channel of member 12 against the side of the channel of member 13. Each member 12 is provided with a projecting flange 12*a* which is arranged to extend over the base of the channel of the member 13. The wall and roof panels are fixed to the members 12 and 13 by glue or, preferably, rivets, and the members 12, 13 are fixed together by perpendicular rivets.

The panels of the walls 4, 5 and roof 6 are preferably made integrally from one piece of the composite structural material. Rounded corners are provided at the junctions of wall 4 and roof 6, roof 6 and wall 5, part 5A of wall 5 and part 5*b* of wall 5, and part 5*b* and part 5*c* of wall 5. The panels of walls 4, 5 and roof 6 may be made by laying up the separate layers of the composite material in an appropriately shaped former in which they are then subject to heat and pressure. Alternatively, the layers may be laid up flat and subject to heat and pressure to partially polymerize the plastics sheets. The flat piece is then folded up around heated rollers to form the corners between the roof 6 and walls 4 and 5 and the parts of wall 5.

The opening 7 in wall 2 and, if provided, in wall 3, is, at the top, defined by the corresponding edge of the panel of the roof 6 which is provided with a member 12 and, at this edge, the opening is strengthened by a box section comprising inverted, nested U-shaped elements 14*a*, 14*b*, which are glued or riveted together and to member 12. On one side, the opening 7 is defined by the edge of wall 4 which is also provided with a member 12 and nested inverted U-shaped members 15*a*, 15*b*, the members 15*a*, 15*b* being glued or riveted together and to member 12. The other side of opening 7 is defined by an edge of the panel of wall 2. This edge is provided with a member 16*a* providing opposed channels, one for receiving the edge portion of the panel of wall 2, and the other for receiving an inverted U-shaped element 16*b* to provide this edge of the opening with a box section.

Figure 6:
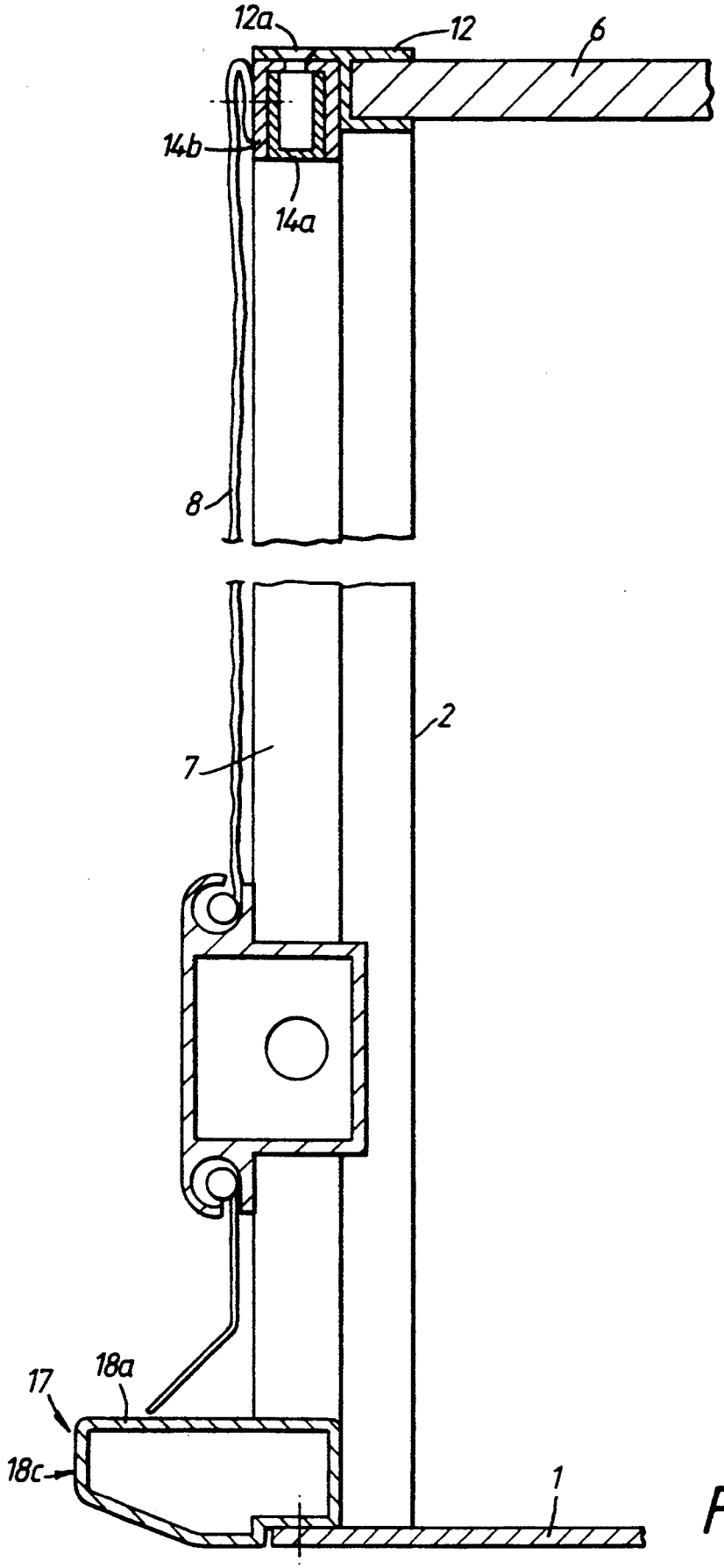
FIG. 6 is a vertical section through the opening in the aft side wall of the container of FIG. 1.
Figure 7:
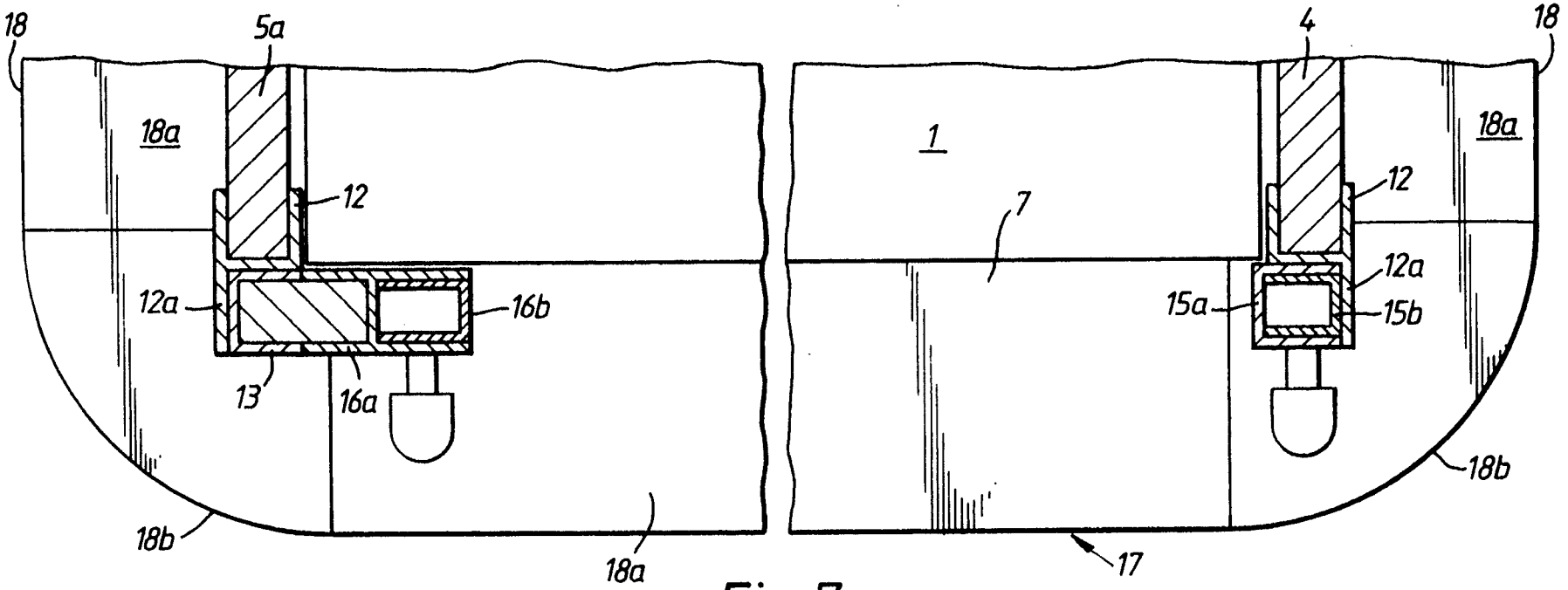
FIG. 7 is a horizontal section through the opening in the aft side wall of the container of FIG. 1.

The flange 17 of the container is provided by elements 18 (FIG. 3) formed integrally with elements 10 and projecting laterally from elements 10. Elements 18 provide a horizontal surface 18*a* for engagement by clamps for clamping the container to the floor of the cargo hold. The elements 18 are extended at the corners by appropriately and correspondingly shaped corner pieces 18*b* (FIG. 7), tubular connectors (not shown) engaging in the hollow interiors of the elements 18 and pieces 18*b* to connect the elements 18 to the pieces 18*b* and these may be welded, glued or riveted together. At the lower edge of the opening 7, the composite elements 10, 18 are modified, as shown at 18*c* in FIG. 6, the base and inner side wall of the channel of element 10 being omitted.

The closure 8, providing a weather-tight closing of opening 7, is conventional and will not be further described.

Elements 10, 18 and members 12, 13, 14*a*, 14*b*, 15*a*, 15*b*, 16*a* and 16*b* may be extruded of aluminium alloy or of any suitable plastics material. Rivets are preferred for fixing the panels to elements 10 and members 12, 13, 14, 15, 16 because the rivets can be removed for repair or replacement of a panel. However, any suitable equivalent removable fixing means may be used, e.g. HOUK (trade mark) bolts or self-tapping screws.

An air cargo container made as described above is substantially lighter than existing, conventional, aluminium framed air cargo containers. For example a container as described above can be at least 22% lighter in weight than a corresponding conventional air cargo container currently in use. The air cargo container as described above is stronger than existing conventional air cargo containers. Since it has no internal framework, there are no internal obstructions limiting efficient filling of the interior of the container. It has a smooth exterior to the walls of the container which are also set back from the edge of the flange surrounding the base of the container, so that binding of one container against another, when loading and unloading the containers, is substantially reduced and may be prevented altogether. This can be achieved while yet providing a container with the same useful internal volume as existing containers. The above described container has an improved impact resistance and is better able to sustain the severe wear and tear of daily use than conventional containers, and is therefore able to remain in service longer than conventional containers.

What is claimed is:

1. An air cargo container comprising a base, four side walls arranged in opposed pairs, and a roof, said side walls and roof being made of panels of composite structural material comprising a core layer, a first outer structural layer which is on the outside of the container and a second outer structural layer which is on the inside of the container, said outer layers being capable of sustaining the tensile, compressive and shear loads to be carried by the container, and means connecting said structural layers of said panels together and to said base along their lower edges in the absence of a structural framework, wherein said core layer comprises closed cell foam, said first outer structural layer comprises an aluminum alloy sheet material bonded to a reinforced thermo-setting plastics sheet material arranged between said aluminum alloy sheet material and said core layer, and said second outer layer of said composite structural material comprises a reinforced thermo-setting plastics sheet material, said roof and one pair of opposed side walls being formed as one piece from a single panel of said composite material.

2. A container as claimed in claim 1, wherein at least two of said side walls are planar over their entire extents.

3. A container as claimed in claim 1, wherein the lower edges of said side walls overlie edges of said base panel.

4. A container as claimed in claim 3, wherein said means connecting said side walls to said base comprises U-shaped channel elements which receive the lower edges of said side walls and are fixed to said base.

5. A container as claimed in claim 4, wherein the lower edges of said side walls are surrounded by a flange fixed thereto and to said base, projecting outwardly of the container and for use in anchoring the container, said flange being formed integrally with said U-shaped channel elements.

6. A container as claimed in claim 1, wherein adjacent edges of the other pair of said side walls and said roof are juxtaposed and means are provided for fixing said juxtaposed edges together, said fixing means being fixed to said structural outer layers of said composite material of said walls.

7. A container as claimed in claim 6, wherein said means connecting said adjacent edges of said side walls and said roof comprise U-shaped channel elements in which edge portions of said side walls and said roof are received, said channel elements being abutted and fixed together.

8. A container as claimed in claim 1, wherein one side wall of said one pair of opposed side walls projects upwardly from said base and is then inclined outwardly and upwardly, said other side wall of said one pair is vertical and planar.

9. A container as claimed in claim 8, wherein the other said pair of opposed side walls are vertical and planar over their entire extents.

10. A container as claimed in claim 1, wherein an opening is provided in one of said side walls, and closure means is provided for closing said opening.

11. A container as claimed in claim 1, wherein said core layer of said composite structural material has a density of at least 60 $kg/m^3$.

12. A container as claimed in claim 1, wherein said first outer layer of said composite structural material has a density of at least 1710 $kg/m^3$.

13. A container as claimed in claim 1, wherein said second outer layer of said composite structural material has a density of at least 1920 $kg/m^3$.

14. A container as claimed in claim 1, wherein said base is made of a material different from that of said side walls and said roof.

15. A container as claimed in claim 14, wherein said material of said base comprises a non-foam core layer and outer layers of non-ferrous metallic sheet material.

16. A container as claimed in claim 1, wherein the lower edges of said side walls are surrounded by a flange fixed thereto and to said base, projecting outwardly of the container and for use in anchoring the container.

* * * * *